US006367819B1

(12) United States Patent
Andersen et al.

(10) Patent No.: US 6,367,819 B1
(45) Date of Patent: Apr. 9, 2002

(54) SHOCK ABSORBING SKATEBOARD TRUCK ASSEMBLY

(76) Inventors: Ole S. Andersen; Scott D. Andersen, both of 2088 Hidden Valley La., Camino, CA (US) 95709

( * ) Notice: Subject to any disclaimer, the term of this patent is extended or adjusted under 35 U.S.C. 154(b) by 0 days.

(21) Appl. No.: 09/528,527

(22) Filed: Mar. 20, 2000

(51) Int. Cl.[7] ..... A63C 3/00

(52) U.S. Cl. ..... 280/11.28; 280/87.042; 280/11.27; 403/224; 411/383

(58) Field of Search ..... 280/11.28, 11.19, 280/11.27, 11.26, 11.23, 11.209, 87.041, 87.042; 403/221, 224, 220; 248/634, 635, 638, 632; 411/383, 384, 371.1, 544, 542; 16/2.1, 2.4

(56) References Cited

U.S. PATENT DOCUMENTS

| | | | | | |
|---|---|---|---|---|---|
| 2,510,722 | A | * | 6/1950 | Snyder | 280/11.28 |
| 2,578,911 | A | * | 12/1951 | Horn | 280/11.28 |
| 2,719,723 | A | * | 10/1955 | Ware | 280/11.209 |
| 3,104,887 | A | * | 9/1963 | Rice et al. | 280/11.209 |
| 3,862,763 | A | * | 1/1975 | Ware | 280/11.28 |
| 4,047,725 | A | | 9/1977 | Pinchock | |
| 4,071,256 | A | * | 1/1978 | Kimmell | 280/11.28 |
| 4,109,925 | A | * | 8/1978 | Williams et al. | 280/11.28 |
| 4,181,316 | A | * | 1/1980 | Brand et al. | 280/87.042 |
| 4,251,087 | A | * | 2/1981 | Hansen | 280/11.28 |
| 4,278,264 | A | * | 7/1981 | Lenz | 280/11.28 |
| 4,398,734 | A | | 8/1983 | Barnard | |
| 4,398,735 | A | | 8/1983 | Evans et al. | |
| 4,645,223 | A | | 2/1987 | Grossman | |
| 4,925,364 | A | * | 5/1990 | Das | 411/383 |
| 5,183,277 | A | * | 2/1993 | Tang | 280/11.28 |
| RE35,123 | E | * | 12/1995 | Wagner | 403/224 |
| 5,853,182 | A | | 12/1998 | Finkle | |
| 5,879,013 | A | * | 3/1999 | Shih | 280/11.28 |

* cited by examiner

*Primary Examiner*—Lanna Mai
*Assistant Examiner*—Hau Phan
(74) *Attorney, Agent, or Firm*—Thomas R. Lampe

(57) ABSTRACT

A shock absorbing skateboard truck assembly includes a resilient shock absorber member located between the assembly base of the assembly and the rest of the assembly for absorbing shocks encountered during use of the skateboard to which the shock absorbing skateboard truck assembly is connected. A shock absorbing element is spaced from the resilient shock absorber member at another truck assembly location.

7 Claims, 5 Drawing Sheets

SHOCK ABSORBING SKATEBOARD TRUCK ASSEMBLY

TECHNICAL FIELD

This invention relates to a truck assembly for skateboards and more particularly to a skateboard truck assembly including structure for absorbing shocks during use of the skateboard.

BACKGROUND OF THE INVENTION

Skateboard truck assemblies typically incorporate an axle support member which is positioned about a king pin with two cushions, bushings or resilient pads being employed in cooperation with the axle support member to control and adjust the steering capabilities of the skateboard employing the truck assembly. Other arrangements exist wherein only a single resilient pad, cushion or bushing is employed for such purpose. However, whether such devices are of a single or double resilient pad type, no appreciable shock absorbing function is provided. Furthermore, adjustment of such devices by applying compressive forces to the resilient pad or pads to change the steering characteristics of the truck assembly can also result in undesirable lessening of what little shock absorber action may exist.

The following patents are believed to be representative of the current state of the art in this field: U.S. Pat. No. 4,398,734, issued Aug. 16, 1983, U.S. Pat. No. 5,853,182, issued Dec. 29, 1998, U.S. Pat. No. 4,047,725, issued Sep. 13, 1977, U.S. Pat. No. 4,398,735, issued Aug. 16, 1983, and U.S. Pat. No. 4,645,223, issued Feb. 24, 1987. The patents noted above do not suggest or teach the structural arrangement disclosed and claimed herein which provides a shock absorbency feature in a skateboard truck assembly, the degree of shock absorbency being adjustable without affecting the steering characteristics of the skateboard truck assembly.

DISCLOSURE OF INVENTION

The present invention relates to a shock absorbing skateboard truck assembly including an assembly base for attachment to the underside of a skateboard.

A king pin projects from the assembly base and has a threaded distal end.

The assembly also includes an axle support member defining an axle support member opening, the king pin projecting through the axle support member opening.

First and second resilient pads encircle the king pin, the first and second resilient pads being spaced from one another and disposed at opposed sides of the axle support member.

Pad retention means retains the first and second resilient pads in position relative to the axle support member and a king pin nut is threadedly engaged with the king pin at the threaded pin thereof.

A resilient shock absorber member is positioned between at least one of said pads and the assembly base. The resilient shock absorber member is annular-shaped and defines a hole receiving the king pin.

Other features, advantages, and objects of the present invention will become apparent with reference to the following description and accompanying drawings.

BEST MODE FOR CARRYING OUT THE INVENTION

Figure 1:
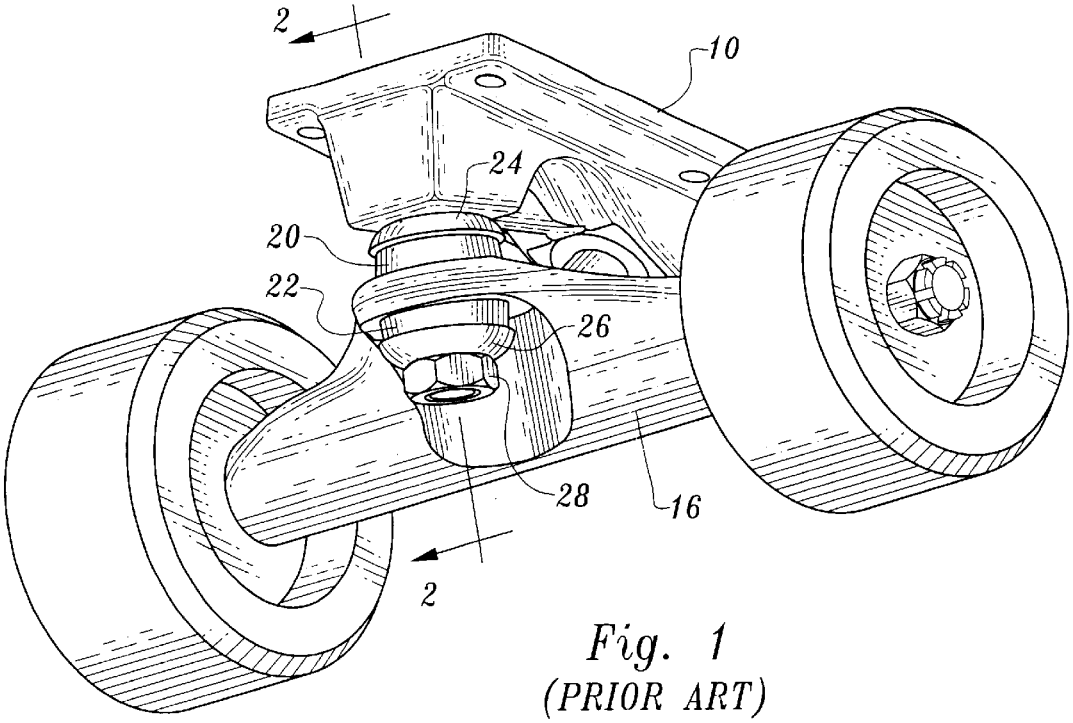
Fig. 1 (PRIOR ART)
FIG. 1 is a perspective view of a typical prior art skateboard truck assembly.
Figure 2:
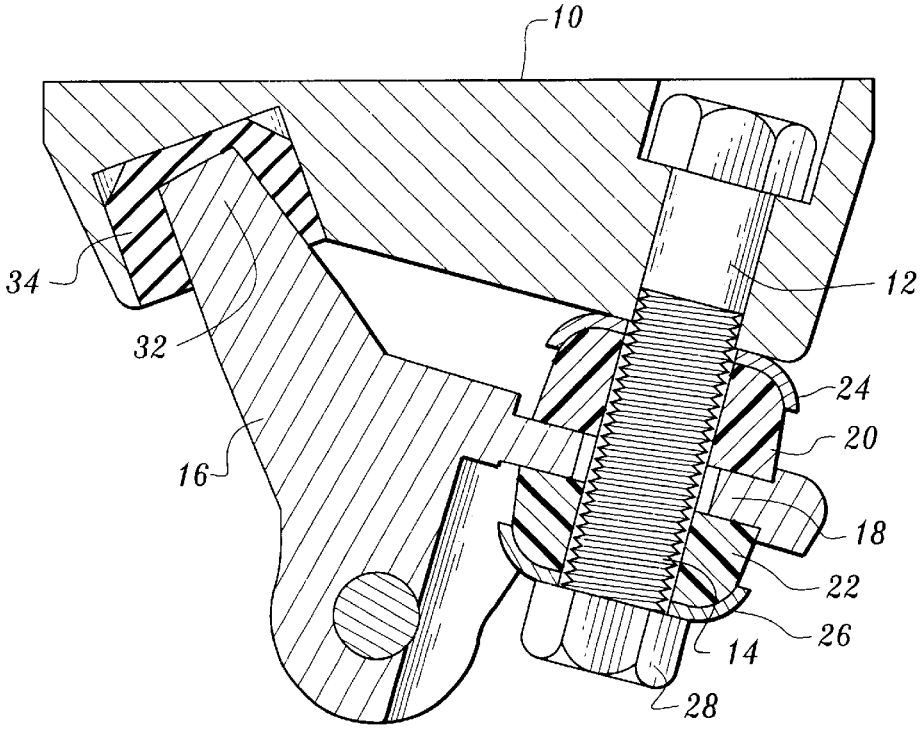
Fig. 2 (PRIOR ART)
FIG. 2 is an enlarged, cross-sectional view taken along line 2—2 in FIG. 1.
Figure 3:
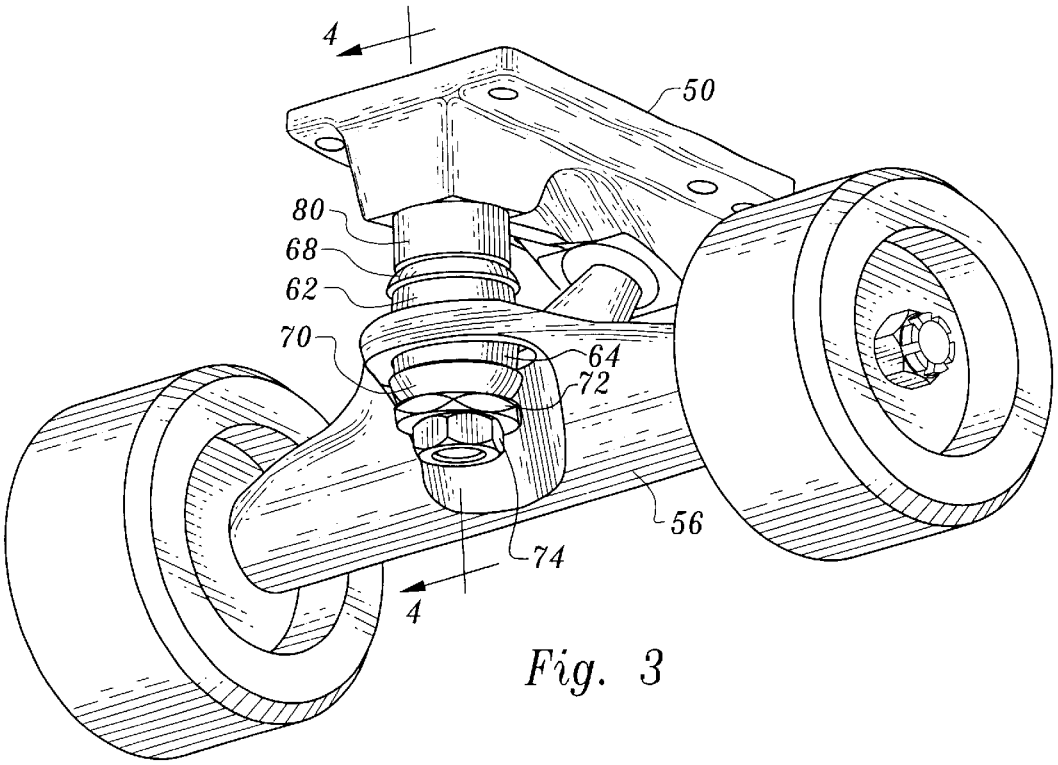
FIG. 3 is a view similar to FIG. 1 but illustrating a shock absorbing skateboard truck assembly constructed in accordance with the teachings of the present invention.
Figure 4:
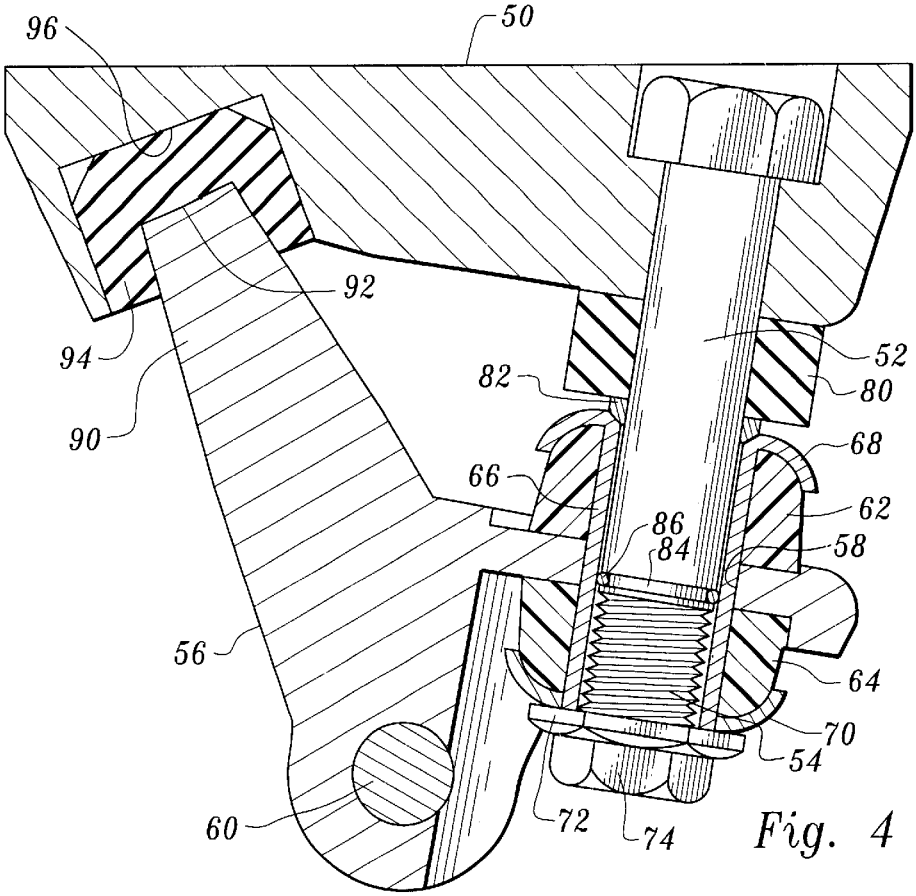
FIG. 4 is an enlarged, cross-sectional view taken along the line 4—4 in FIG. 3.
Figure 5:
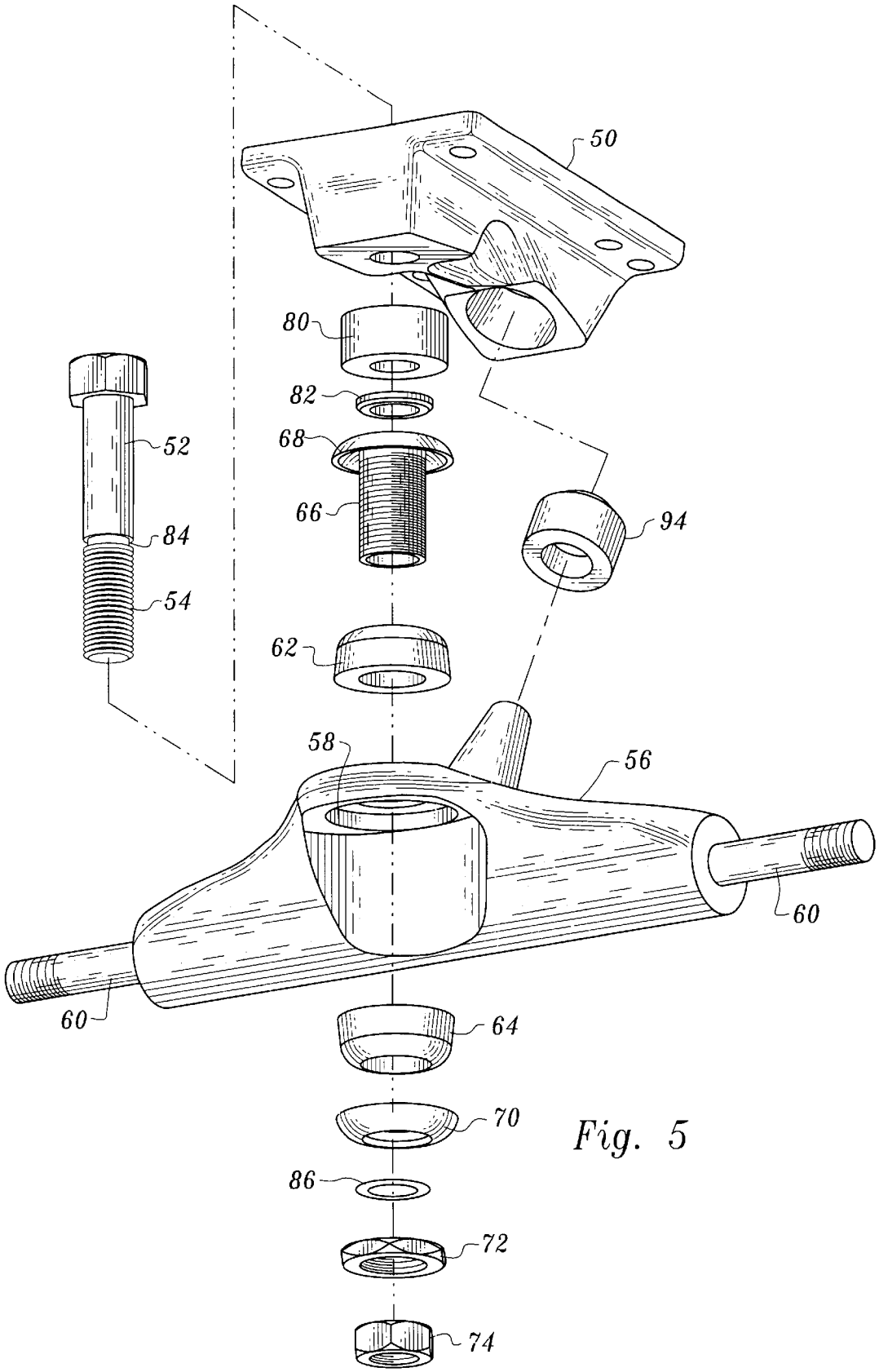
FIG. 5 is an exploded, perspective view illustrating the components of the shock absorbing skateboard truck assembly of FIG. 3.
Figure 6:
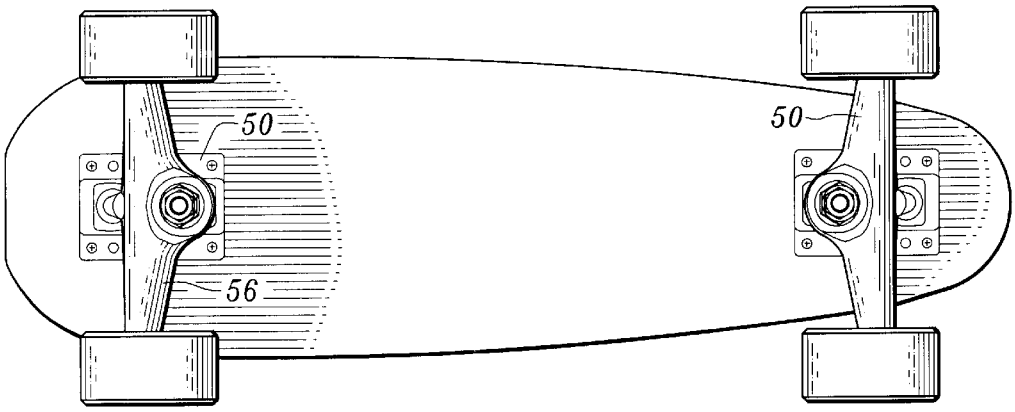
FIG. 6 is a bottom plan view of a skateboard to which are attached two shock absorbing skateboard truck assemblies of the type shown in FIG. 3.
Figure 7:
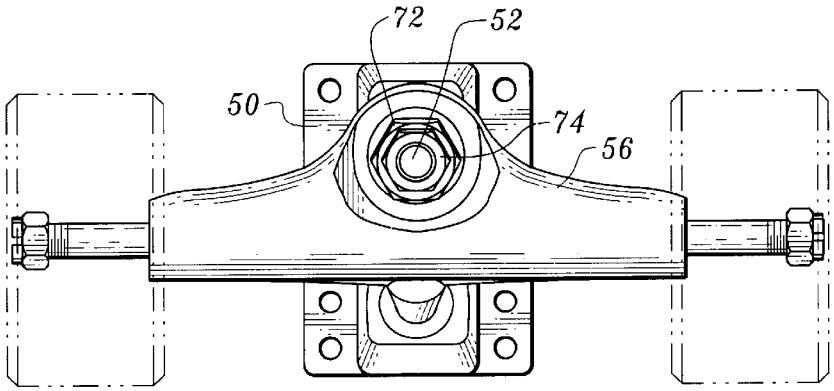
FIGS. 7 and 8 are enlarged, bottom plan views of the shock absorbing skateboard truck assembly, wheels shown in phantom, with FIG. 8 illustrating a typical configuration of the assembly components when making a turn.
Figure 8:
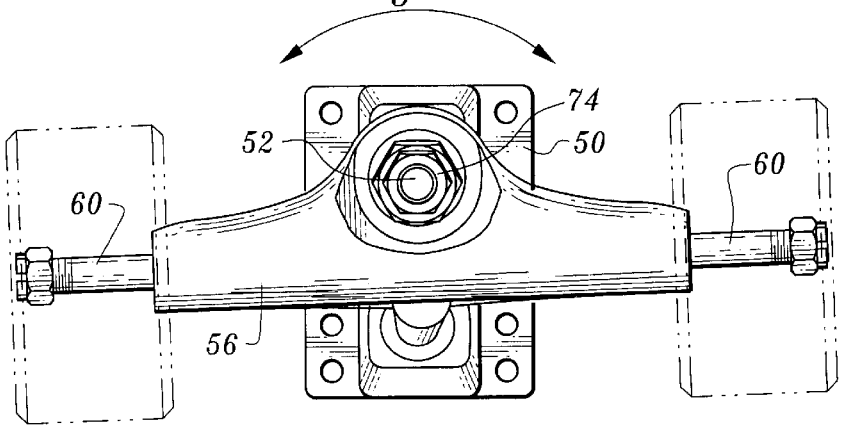
Figure 9:
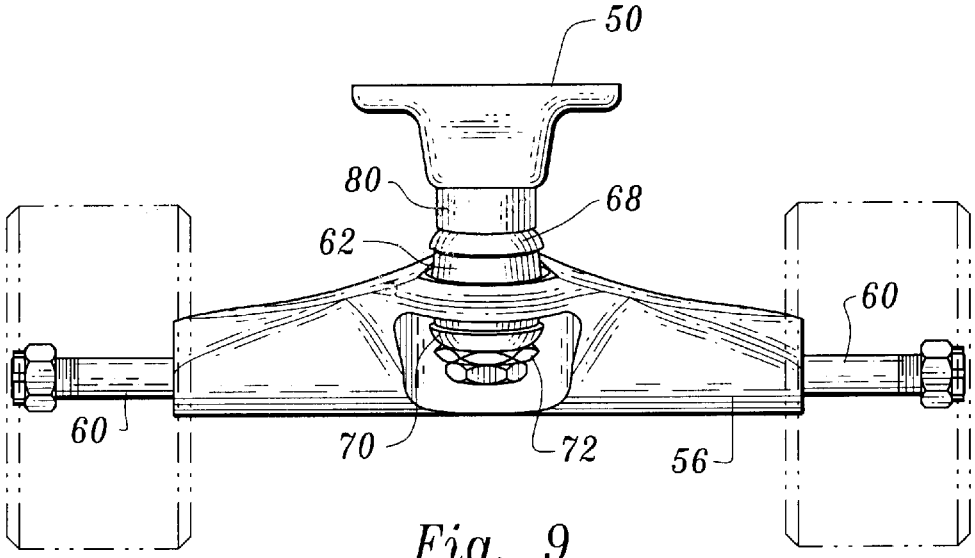
FIGS. 9 and 10 are elevational views of the truck assembly, wheels being shown in phantom, with FIG. 10 illustrating tilting of the wheel axles and related structure as typically occurs during skateboard use.
Figure 10:
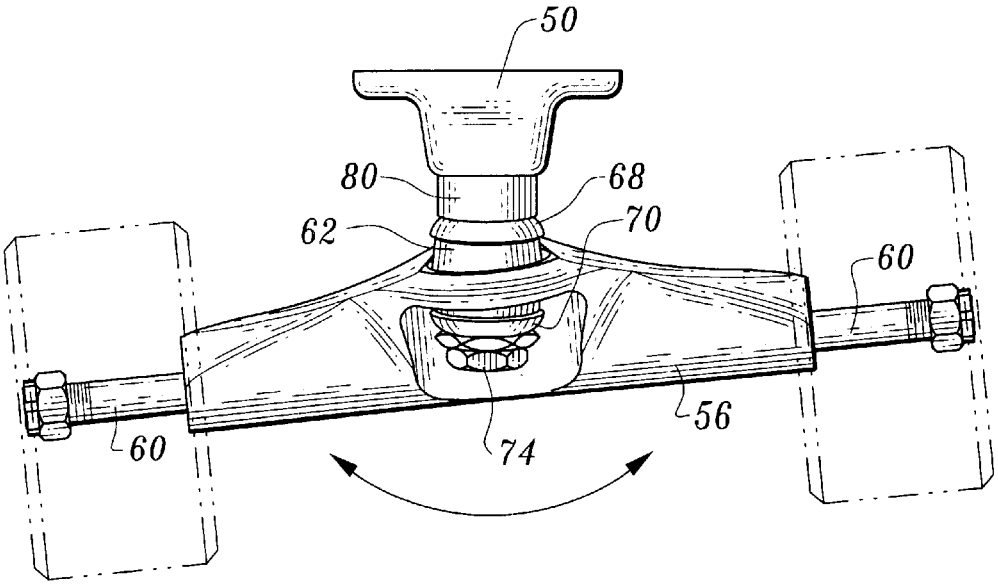

FIGS. 1 and 2 illustrate a typical prior art skateboard truck assembly having minimal shock absorbing capability. The assembly includes an assembly base 10 for attachment to the underside of a skateboard by screws or the like. A king pin 12 projects from the assembly base and has a threaded distal end 14.

An axle support member 16 defines an axle support member opening 18, the king pin 12 projecting through the axle support member opening. Resilient pads, bushings or cushions 20, 22 encircle the king pin. The resilient pads are spaced from one another and disposed on opposed sides of the axle support member. Located above pad 20 and in engagement therewith is a cup-shaped washer 24 encircling the king pin and disposed between the assembly base 10 and pad 20. A similarly shaped washer 26 is disposed under resilient pad 22. A king pin nut 28 is threadedly engaged with the threaded end of king pin 12 and is in engagement with washer 26. Tightening or loosening of the king pin nut will respectively increase or decrease compressive forces applied to the resilient pads to modify the steering capabilities of the skateboard to which the assembly is connected. It will be appreciated that an increase in those compressive forces applied to the resilient pads will lessen even more what little shock absorber function the pads provide.

Axle support member 16 includes an axle support member arm 30 having a distal end 32. Distal end 32 is positioned in a bearing element 34 disposed in a recess of the assembly base. The bearing element 34 is relatively hard but permits some movement of the distal end relative to the assembly base during use of the skateboard, the bearing element also possibly providing a minimal degree of shock absorbency.

Referring now to FIGS. 3–10, a shock absorbing skateboard truck assembly constructed in accordance with the teachings of the present invention has several structural components of the type utilized in the prior art device shown in FIGS. 1 and 2. The shock absorbing skateboard truck assembly includes an assembly base 50 for attachment to the underside of a skateboard and a king pin 52 projecting from the assembly base and having a threaded distal end 54. An axle support member 56 defines an axle support member opening 58, the king pin 52 projecting through the axle support member opening. Axles 60 project from the ends of axle support member 56, upon which are mounted the skateboard wheels.

Resilient pads 62, 64 encircle the king pin, the resilient pads being spaced from one another and disposed at opposed sides of the axle support member.

Pad retention means retains the first and second resilient pads in position relative to the axle support member. More particularly, a double-ended, elongated, threaded bushing 66 extends around the king pin and is disposed within the resilient pads 62, 64. The bushing is axially slidably movable relative to the king pin. A flange 68 comprising part of the pad retention means is affixed to and radially extends outwardly from one of the ends of the bushing, the flange adjoining resilient pad 62. The flange 68 defines a recess for receiving resilient pad 62 to secure it in place.

The pad retention means also includes a retention member 70 under resilient pad 64. Retention member 70 is cup-shaped, having an opening therein. The retention member 70 is disposed about the threaded end of the bushing and defines a recess for receiving the resilient pad 64. A bushing nut 72 is threadedly engaged with the threaded end of the bushing. A king pin nut 74 is threadedly engaged with the king pin at the threaded distal end of the king pin. The bushing nut and the king pin nut are adjacent to one another and coaxial.

Positioned between flange 68 and assembly base 50 is a resilient shock absorber member 80 formed of elastomeric material, rubber or the like. The resilient shock absorber member is annular-shaped and defines a hole receiving the king pin. In the arrangement illustrated, a washer 82 formed of plastic or the like extends about the king pin and is positioned between the upper end of the bushing and the resilient shock absorber member.

The king pin has a groove 84 comprising an O-ring seat about the outer periphery thereof. An O-ring 86 is located in the groove and projects outwardly from the king pin into engagement with the bushing 66. When washer 82 is under compression a portion thereof is located between the king pin and the bushing. Thus, the washer 82 and the O-ring 86 serve to reduce or even eliminate direct frictional engagement between the bushing and the king pin. As stated above, the bushing is slidable relative to the king pin. Rotation of king pin nut 74 will result in adjustment of the suspension stiffness by changing the compressive forces applied to shock absorber member 80. On the other hand, rotation of bushing nut 72 in threaded engagement with bushing 66 will vary the compressive forces applied to resilient pads 62, 64, thereby providing for steering adjustment.

Axle support member 56 includes an axle support member arm 90 having a distal end 92. This distal end fits in a shock absorbing element 94 located in assembly base recess 96, as perhaps best may be seen in FIG. 4. The shock absorbing element 94 is preferably made of elastomeric material and also is preferably friction fit or otherwise releasably secured in recess 96 so that shock absorbing elements of different hardness can be substituted for one another, depending upon whether or not a smoother or firmer ride is desired. The same is true for the shock absorber member 80. A rider can select a shock absorber member providing either a greater or lesser degree of hardness depending upon whether a firmer or smoother ride is desired.

What is claimed is:

1. A shock absorbing skateboard truck assembly comprising, in combination:

an assembly base for attachment to the underside of a skateboard;

a king pin projecting from said assembly base and having a threaded distal end;

an axle support member defining an axle support member opening, said king pin projecting through said axle support member opening;

first and second resilient pads encircling said king pin, said first and second resilient pads being spaced from one another and disposed at opposed sides of said axle support member;

pad retention means retaining said first and second resilient pads in position relative to said axle support member;

a king pin nut threadedly engaged with said king pin at the threaded distal end of said king pin;

a resilient shock absorber member positioned between said first and second resilient pads and said assembly base and between said pad retention means and said assembly base, said resilient shock absorber member defining a hole receiving said king pin, rotation of said king pin nut on said king pin changing the compressive forces applied to said resilient shock absorber member;

a double-ended bushing extending around said king pin and disposed within said first and second resilient pads, said bushing being axially slidably movable relative to said king pin selectively toward or away from said assembly base, said pad retention means including a flange radially extending outwardly from one of the ends of said bushing, said flange adjoining one of said resilient pads, the end of said bushing remote from said flange being a threaded end; and a bushing nut threadedly engaged with the threaded end of said bushing, rotation of said bushing nut on said bushing varying the compressive forces applied to said resilient first and second pads to change the steering characteristics of said truck assembly.

2. The shock absorbing skateboard truck assembly according to claim 1 wherein said flange defines a recess receiving the resilient pad adjoining said flange.

3. The shock absorbing skateboard truck assembly according to claim 1 wherein said pad retention means additionally comprises a retention member disposed about the threaded end of said bushing and defining a recess for receiving the resilient pad not adjoining said flange.

4. The shock absorbing skateboard truck assembly according to claim 1 wherein said bushing nut and said king pin nut are coaxial and adjacent to one another.

5. The shock absorbing skateboard truck assembly according to claim 1 wherein said king pin defines an O-ring seat about the outer periphery thereof, said shock absorbing skateboard truck assembly additionally comprising an O-ring positioned in said O-ring seat and projecting outwardly from said king pin into engagement with said bushing.

6. The shock absorbing skateboard truck assembly according to claim additionally comprising a washer extending about said king pin and positioned between said bushing and said resilient shock absorber member.

7. The shock absorbing skateboard truck assembly according to claim 1 wherein said assembly base defines an assembly base recess spaced from said king pin and wherein said axle support member includes an axle support member arm having a distal end positionable in said assembly base recess, said shock absorbing skateboard truck assembly additionally comprising a shock absorbing element located in said assembly base recess, said shock absorbing element defining a shock absorbing element recess receiving the distal end of said axle support member arm.

* * * * *